United States Patent [19]

Gisewsky

[11] 4,014,600

[45] Mar. 29, 1977

[54] SELF-CLEANING DEVICE FOR DETACHABLY CONNECTING ELECTRICAL CONDUCTOR WIRES

[76] Inventor: Karl-Robert Gisewsky, Ascheberger Str. 75, Plon, Germany

[22] Filed: Dec. 11, 1975

[21] Appl. No.: 639,838

Related U.S. Application Data

[63] Continuation of Ser. No. 491,376, July 24, 1974, abandoned.

[52] U.S. Cl. ..... 339/48

[51] Int. Cl.[2] ..... H01R 31/02

[58] Field of Search ..... 339/47–49, 339/95 R, 95 A, 151 B

[56] References Cited

UNITED STATES PATENTS

| | | | |
|---|---|---|---|
| 551,930 | 12/1895 | Greene | 339/49 R X |
| 1,392,558 | 10/1921 | Darram et al. | 339/48 X |
| 2,814,790 | 11/1957 | Stoll et al. | 339/151 B X |
| 3,378,810 | 4/1968 | Dorrell | 339/95 R |
| 3,441,898 | 4/1969 | Nodfelt | 339/48 |

*Primary Examiner*—Gerald A. Dost
*Attorney, Agent, or Firm*—Herbert L. Lerner

[57] ABSTRACT

An electrical connector consisting of two coupling halves equipped with contact elements wherein the contact elements are inserted into an elastically resilient insulator with the contact elements of one coupling half having a spherical contact surface and with the contact elements of the other coupling half having an inclined trough-shaped contact surface for mating contact whereupon mating of the contact elements induces lateral relative motion of the contact elements with rubbing action cleaning the contact surfaces and with pushing away dirt particles contained in the trough.

3 Claims, 8 Drawing Figures

SELF-CLEANING DEVICE FOR DETACHABLY CONNECTING ELECTRICAL CONDUCTOR WIRES

This is a continuation of application Ser. No. 491,376, filed July 24, 1974, now abandoned.

This invention relates to a device for detachably connecting electrical conductor wires, and more particularly refers to a new and improved electrical connector consisting of two coupling halves equipped with contact elements in each coupling half, which contact elements have contact surfaces for mating contact.

DESCRIPTION OF THE PRIOR ART

German Published Prosecuted Application DAS 1,008,377 describes a device in which the contact elements of a coupling half have circular cups with a circular cross section perpendicular to the effective direction of the contact pressure.

This device has the drawback that it has only a very limited capability of self-cleaning. For this purpose a central hole (blind hole) is provided, into which dirt particles in the cup can be forced. Unfortunately, the blind hole fills rapidly with dirt, and this can happen very quickly under dirty conditions in outdoor use. Correcting this situation is a laborious and time-consuming job, particularly in the case of a multi-contact connection, requiring removal of the dirt from each blind hole.

In U.S. Pat. No. 3,185,955 a chisel-shaped contact cooperates with a notch-shaped mating contact. In this device, the edge of the chisel is turned in the rest position of the chisel by a small angular amount relative to the long direction of the notch, so that the chisel upon entering the notch executes a torsion movement. The stated purpose of this arrangement is to generate an adequate contact pressure. Although a certain amount of polishing of the contact surface could take place here, the dirt which may be deposition in the notch is not removed thereby, but rather it is pushed firmly into the notch.

It is accordingly an object of the present invention to provide an electrical conductor in which self-cleaning of the contact surfaces of dirt as well as of oxide layers may be continued indefinitely.

It is a further object of the invention to provide such a device which, in its entirety, is of relatively simple and economical construction and operates efficiently.

SUMMARY

With the foregoing and other objects in view, there is provided in accordance with the invention, in an electrical connector for detachably connecting electrical conductor wires consisting of two coupling halves with a plurality of contact elements in a coupling half making contact with a corresponding plurality of contact elements in the other coupling half when the coupling halves are mated, the combination therewith of mounting the contact elements into an elastically resilient insulator to permit lateral movement of the contact elements, the elements in one coupling half having a spherical contact surface and the contact elements in the other coupling half having a trough-shaped contact surface for mating contact with the contact elements having a spherical contact surface, the trough-shaped contact surface being inclined at an angle deviating from a perpendicular to the direction of contact pressure applied with introduction of the mating contact element whereupon insertion of a mating contact element having a spherical contact surface in the inclined trough-shaped contact surface induces lateral relative motion of said two mating contact elements with rubbing action of the contact surfaces cleaning the contact surfaces and with pushing away dirt particles contained in the trough.

In accordance with another feature of the invention, the trough-shaped contact surface is inclined at an angle of about 70° to 80° to the perpendicular to the direction of the contact pressure.

In accordance with a further feature of the invention, a coupling half has a group of contact elements with a spherical contact surface and a group equal in number of contact elements with an inclined trough-shaped contact surface the contact elements in the groups being symmetrically arranged with respect to a horizontal axis and a vertical axis of said coupling half, a mating coupling half having the identical arrangement of groups, an orientation pin in one coupling half with a corresponding hole in the other coupling half to insure coupling alignment of the two coupling halves.

Thus, according to the invention, in one coupling half are provide contact elements having a spherical contact surface and in the other coupling half contact elements are provided as mating contacts which have a trough-shaped contact surface, with the long trough direction of the trough-shaped contact surfaces arranged at an angle deviating from 90° to the effective direction of the contact pressure.

The inclination of the longitudinal trough direction of the trough-shaped contact surfaces has the effect that a component of the contact pressure directed parallel to the long direction of the depression occurs, pushing the spherical contact element to one side, so that it executes a rubbing motion in the trough. This lateral movement is possible as the insulator is elastically resilient. With this rubbing motion, dirt particles are pushed to one side and finally, out of the trough; at the same time, the contact surfaces are rubbed clean.

With respect to the degree of inclination, it has been found particularly advantageous to arrange the trough-shaped contact surfaces with the long trough direction at an angle of about 70° to 80°, preferably 90°, minus about 15° to the effective direction of the contact pressure.

Other features which are considered as characteristic for the invention are set forth in the appended claims.

Although the invention is illustrated and described herein as self cleaning device for detachably connecting electrical conductor wires, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, together with additional objects and advantages thereof, will be best understood from the following description when read in connection with the accompanying drawing in which.

DESCRIPTION OF THE PREFERRED EMBODIMENTS

Figure 1:
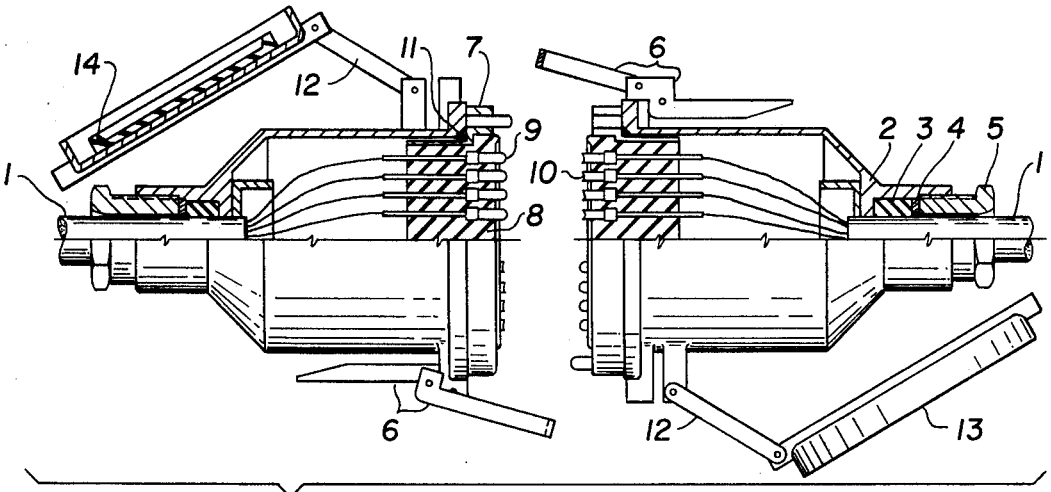
FIG. 1 is a diagrammatic elevational view of an electrical connector showing the two coupling halves, their upper halves being shown in longitudinal cross section.

In FIG. 1 an electrical connection between two cable ends 1 by means of coupling halves is illustrated. The cable ends are inserted into the housing 2 in a known manner and sealed by a stuffing gland 3, pressure washer 4 and threaded nipple 5. Since the two coupling halves may be identical, description and explanation of only one coupling half will suffice for both coupling halves. With identical coupling halves, the correct joining of the two halves may be accomplished by rotating the one relative to the other by no more than 180° about their longitudinal axis, as will be explained further with the aid of FIG. 5.

The draw lever 6 serves to press and hold the two coupling halves together. Such devices are known and are not material to the present invention. Located in housing 2 are contact insert 7. Insulator 8 consists of an elastically resilient insulating material with contact elements 9 and mating contact elements 10 arranged in elastically resilient insulator 8. The contact carrier insert 7 is sealed water-tight in the housing 2 by a seal 11. Cap 13 with a seal 14, which is attached to the housing 2 via a hinged joint 12 serves as a water-tight seal for the housing if the coupling half is not in use.

Figure 2A:
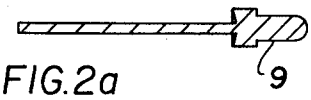
FIGS. 2*a*, 2*b* and 2*c* are enlarged views of the contact elements illustrated in FIG. 1 showing one each of the cooperating contact elements.
Figure 2B:
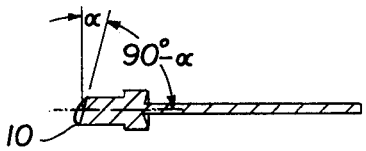
Figure 2C:
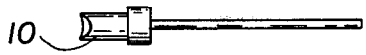

FIGS. 2*a*, 2*b* and 2*c*, the contact element 9 and the mating contact element 10 are shown magnified. The contact element 9 is of rotational symmetry and has a spherical contact surface. The mating contact element 10, on the other hand, has a trough or cup-shaped contact surface, which is inclined by an angle of about 15° against the end face of the coupling half, so that the angle between the long dimension of the trough and the effective direction of the contact pressure deviates about 15° from 90°. The effective direction of contact pressure is the direction of contact element 9 as it enters trough-shaped element 10 with application of pressure to move it in contact with the surface of element 10. The effective direction of contact pressure, that is, upon application of pressure before lateral movement of the contact element is longitudinal and as illustrated in FIGS. 2*a*, 2*b* and 2*c* extends lengthwise along the axis of the contact elements.

The trough-shaped surface of element 10 as illustrated in FIGS. 2*b* and 2*c* has a surface which deviates from the effective direction of the contact pressure by about 75°. As the spherical surface of element 9 contact the trough-shaped surface of element 10, continued pressure forces element 9 along the inclined surface of trough-shaped element 10, thereby causing lateral movement. To facilitate this lateral movement, the rim or lip of the trough is uneven, e.g. the distance from the rim to the furthest point in the depression of the trough is longest where the trough surface is inclined with movement of spherical surface upward along the incline and shortest where the spherical surface moves laterally. In FIGS. 2*b* and 2*c*, the rim of the trough is shown at an angle to the horizontal axis with rim extending the farthest having an inclined surface and the upper or shorter part of the rim permitting lateral movement of mating contact.

Figure 3:
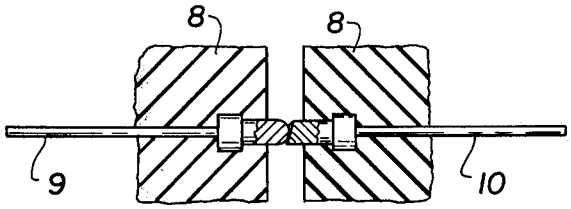
FIGS. 3 and 4 are views of the contact elements of FIG. 1, showing two phases of the contact elements in the coupling process.
Figure 4:
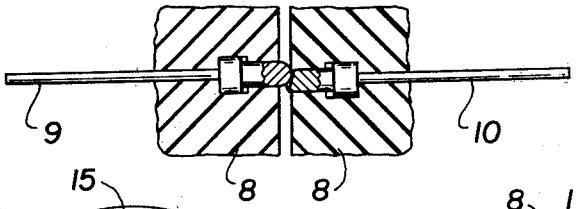

FIGS. 3 and 4 show two phases of motion of the contact elements 9 and 10 when putting the coupling halves together. How the self-cleaning comes about will be explained with the aid of these figures.

In FIG. 3, the contact element 9 has just reached the contact element 10 and settled on the trough-shaped contact surface of the latter. The contact pressure, which increases as the coupling halves are pressed together further, is split at the inclination of the trough into a normal and a transversal component. The transversal component, which coincides with the long direction of the trough, causes the already mentioned sideways motion of the contact element 9. As the normal component in turn is split again, and specifically into a component which coincides with the direction of the contact pressure and a transversal component which is opposed to the first-mentioned transversal component, the contact element 10 is deflected slightly sideways, and specifically, toward the other side.

As a result of the lateral relative motion of the two contact elements, the rubbing action of the contact elements, causing the self-cleaning effect, is brought about. When the coupling halves are separated, the contact elements are returned to their normal position due to the elasticity of the insulator. Gross contamination, such as mud splatter or the like, can be removed easily with this contact shape by brushing.

Figure 5:
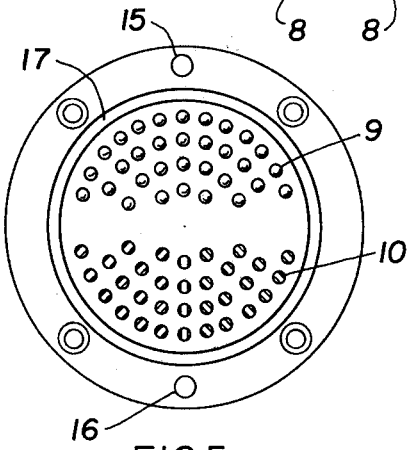
FIG. 5 is a view of the end face of a coupling half illustrated in FIG. 1, showing an arrangement of the contact elements.
Figure 6:
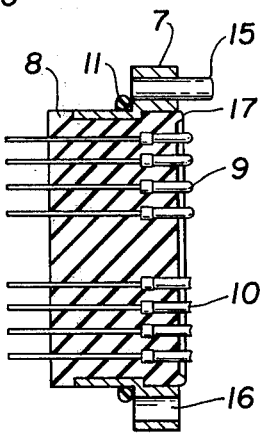
FIG. 6 is a view of a longitudinal cross section of the mounting of contacts with the contact elements embedded in the insulator.

The arrangement of the contact elements can be seen from the end face of a coupling half shown in FIG. 5 and the longitudinal cross section of the contact mounting shown in FIG. 6. Above the horizontal axis of symmetry, only spherical contact elements 9, and below this axis of symmetry, only contact elements 10 provided with a trough-shaped contact surface are arranged. The arrangement is made so that the grouping of the lower half is a mirror image of the upper half at the horizontal symmetry axis and the vertical symmetry axis. If, however, as usual and the case also here, the contact elements of one kind are already arranged symmetrically to the vertical axis of symmetry, the grouping of the contact elements of the other kind is made a mirror image, namely, arranged symmetrically to the horizontal axis of symmetry.

Because of this contact grouping, one and the same design can be used for both coupling halves. To ensure that both coupling halves are not misaligned and can be aligned by a rotating a coupling half by no more than 180°, the flange of each coupling half is provided in the region of the one group of contacts with an orientation pin 15 and, diametrically opposite the latter, in the region of the other contact group, with a guide bushing. A sealing bead 17 is maybe provided to protect the contact space against the entry of water, after the coupling halves have been joined together.

It is claimed:

1. In an electrical connector for detachably connecting electrical conductor wires consisting of two coupling halves with a plurality of contact elements in a coupling half making contact with a corresponding plurality of contact elements in the other coupling half when said coupling halves are mated, the combination therewith of mounting said contact elements into an elastically resilient insulator to permit lateral movement of said contact elements, the contact elements in one coupling half having a spherical contact surface and the contact elements in the other coupling half having a trough-shaped contact surface for mating contact with said contact elements having a spherical contact surface, said trough-shaped contact surface being unitarily inclined at an angle deviating from a perpendicular to the direction of contact pressure applied with introduction of said mating contact element to permit upon insertion of a mating contact element having a spherical contact surface into said unitarily inclined trough-shaped contact surface lateral relative motion of said two mating contact elements with rubbing action of the contact surfaces cleaning the contact surfaces and with pushing away dirt particles contained in the trough.

2. Electrical connector according to claim 1 wherein said inclined trough-shaped contact surface is inclined at an angle of about 70° to 80° to the perpendicular to the direction of said contact pressure.

3. Electrical connector according to claim 1 wherein a coupling half has a group of contact elements with a spherical contact surface and a group equal in number of contact elements with an inclined trough-shaped contact surface, the contact elements in the groups being symmetrically arranged with respect to a horizontal axis and a vertical axis of said coupling half, a mating coupling half having the identical arrangement of groups, an orientation pin in one coupling half with a corresponding hole in the other coupling half to insure coupling alignment of the two coupling halves.

* * * * *